US006358403B1

(12) United States Patent
Brown et al.

(10) Patent No.: US 6,358,403 B1
(45) **Date of Patent: *Mar. 19, 2002**

(54) PROCESS FOR RECOVERY OF HYDROCARBON FROM TAILINGS

(75) Inventors: Wayne Brown; Barry Bara; Sukhamoy Sarkar, all of Edmonton (CA); Rodney Denton, Fayetteville, NC (US)

(73) Assignee: AEC Oil Sands, L.P. (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/316,002

(22) Filed: May 21, 1999

(30) Foreign Application Priority Data

May 14, 1999 (CA) ..... 2272035

(51) Int. Cl.[7] ..... C10G 1/04
(52) U.S. Cl. ..... 208/390; 208/391
(58) Field of Search ..... 208/390, 391

(56) References Cited

U.S. PATENT DOCUMENTS

| | | | | | |
|---|---|---|---|---|---|
| 4,126,743 | A | * | 11/1978 | Shiomura et al. | 528/503 |
| 4,613,484 | A | * | 9/1986 | Ayers et al. | 422/132 |
| 5,236,577 | A | * | 8/1993 | Tipman et al. | 208/390 |
| 5,985,138 | A | * | 11/1999 | Humprrys | 208/390 |

FOREIGN PATENT DOCUMENTS

| | | |
|---|---|---|
| CA | 1027501 | 3/1987 |
| CA | 1239888 | 8/1999 |

* cited by examiner

*Primary Examiner*—Helane E. Myers

(57) ABSTRACT

A process for recovery of hydrocarbon diluent from tailings produced in a bitumen froth treatment plant comprises introducing the tailings into a vacuum flash vessel maintained at a sufficiently low sub-atmospheric pressure to vaporize the major portion of the contained diluent and some water. The residual then pool near the bottom of the flash vessel. Steam is then introduced into the tailings pool for vaporizing residual diluent and some water.

12 Claims, 2 Drawing Sheets

PROCESS FOR RECOVERY OF HYDROCARBON FROM TAILINGS

FIELD OF THE INVENTION

The present invention relates to a method for recovery of hydrocarbon diluent from a slurry such as tailings produced in a bitumen froth treatment plant. More particularly, hydrocarbon diluent is removed from the tailings in a vacuum flash vessel that also operates as a sparging vessel.

BACKGROUND OF THE INVENTION

Oil sand, as known in the Fort McMurray region of Alberta, Canada, comprises water-wet sand grains having viscous bitumen flecks trapped between the grains. The bitumen is a form of heavy oil. The oil sand lends itself to separating or dispersing the bitumen from the sand grains by slurrying the as-mined oil sand in water so that the bitumen flecks move into the aqueous phase.

For the past 25 years, the bitumen in McMurray oil I sand has been commercially recovered using a hot water process. In general, the process involves slurrying oil sand with heated water, steam, usually some caustic and naturally entrained air. The slurry is mixed, commonly in tumblers, for a prescribed retention time to initiate a preliminary separation or dispersal of the bitumen and the solids and to induce air bubbles to contact and aerate the bitumen. The conditioned slurry is then subjected to flotation to further separate the bitumen from the sand.

A recent development in the recovery of bitumen from oil sand involves a low temperature process whereby the oil sand is mixed with heated water directly at the mine site to produce a pumpable, dense, low temperature slurry. The slurry is then pumped through a pipeline to condition the slurry for flotation.

The conditioned slurry obtained by either process described above is further diluted with heated water and introduced into a large, open-topped, conical-bottomed, cylindrical vessel (termed a primary separation vessel or "PSV"). The diluted slurry is retained in the PSV under quiescent conditions for a prescribed retention period. During this period, the aerated bitumen rises and forms a froth layer, which overflows the top lip of the vessel and is conveyed away in a launder. The sand grains sink and are concentrated in the conical bottom. They leave the bottom of the vessel as a wet tailings stream. Middlings, a watery mixture containing solids and bitumen, extend between the froth and sand layers.

The wet tailings and middlings are withdrawn, combined and sent to a secondary flotation process. This secondary flotation process is commonly carried out in a deep cone vessel wherein air is sparged into the vessel to assist with flotation. This vessel is referred to as the TOR vessel. It and the process conducted in it are disclosed in U.S. Pat. No. 4,545,892, incorporated herein by reference. The bitumen recovered by the TOR vessel is recycled to the PSV. The middlings from the deep cone vessel are further processed in air flotation cells to recover contained bitumen.

The froths produced by these units are combined and subjected to further processing. More particularly, it is conventional to dilute the bitumen froth with a hydrocarbon diluent, such as a paraffinic diluent or naphtha, to first improve the difference in specific gravity between the bitumen and water and to reduce the bitumen viscosity, to aid in the separation of the water and solids from the bitumen. Separation of the bitumen from water and solids is commonly achieved by treating the froth in a sequence of scroll and disc centrifuges. However, there has been a recent trend towards using an inclined plate settling process for separating bitumen from the water and solids.

The primarily water and solids fraction obtained after separation is commonly referred to as froth treatment tailings consisting of a slurry. These froth treatment tailings typically containing approximately 2.0 wt. % hydrocarbon diluent, 4.5 wt. % bitumen, 17 wt. % particulate solids and 76.5 wt. % water. It is desirable both economically and environmentally to recover the hydrocarbon diluent from the tailings prior to disposal.

The unique nature of the diluent-containing tailings make diluent removal a challenge to the industry.

Canadian Patent No. 1,027,501 teaches a process for treatment of centrifuge tailings to recover naphtha. The process comprises introducing the tailings into a distributor at the upper end of the chamber of a vacuum flash vessel or tower maintained at 35 kPa, in order to flash the naphtha present in the tailings. The vessel is also equipped with a stack of interial shed decks for enhancing contact between stripping steam and the tailings feed. The steam is introduced at a point above the liquid pool in the vessel and below the stack of shed decks. The steam is intended to heat the flashed tailings as they pass down through the shed decks, to vaporize contained diluent and some water, for recovery as an overhead stream.

In practice, however, this process results in only 60 to 65% recovery of the diluent, hence, a large amount of diluent is still being released to the environment.

SUMMARY OF THE INVENTION

The present invention is directed towards improving the recovery of hydrocarbon diluent from a slurry, comprising heavy oil, particulate solids, diluent and water, in a vacuum flash vessel. Preferably the slurry is froth treatment+tailings.

In accordance with the invention, heated (approximately 80° C.) tailings are introduced into a vacuum flash vessel chamber maintained at sub-atmospheric pressure. The tailings flash adiabatically to produce hydrocarbon diluent and water vapours It has been determined that in the case of froth treatment tailings, about 60 to 65% of the diluent is being vaporized as a result of this flashing stage. The residual tailings (which still contain 35 to 40% of the diluent) form a pool at the bottom of the vacuum vessel. Steam is sparged directly into the pooled tailings. Sufficient steam is added to the residual tailings pool to cause the vaporization of additional diluent and part of the water. In the case of froth treatment tailings, the total recovery of naphtha can be increased to around 80 to 85%.

Broadly stated, the present invention involves a method for recovering hydrocarbon diluent from a slurry comprising heavy oil, particulate solids, diluent and water, comprising:

introducing the slurry into a vacuum flash vessel chamber maintained at a sufficiently low sub-atmospheric pressure to flash the major portion of the contained diluent and some water and forming a pool of residual slurry at the bottom of the chamber introducing sufficient steam into the pool to vaporize contained diluent and water; and separately removing vapors and residual tailings from the chamber.

In a preferred embodiment, the flash vessel chamber is maintained at a pressure of about 13 to 70 kPa, and more preferably is maintained at a pressure of about 30 to 35 kPa.

In another preferred embodiment, the tailings are introduced to the flash vessel chamber at a rate of about 150 to 300 kg/sec and steam is injected into the residual tailings pool at a rate of about 7 to 14 kg/sec.

In another preferred embodiment, the hydrocarbon diluent being recovered is naphtha or paraffinic diluent.

In another preferred embodiment, the hydrocarbon diluent and water vapors are condensed and separated in a decanter. The diluent can then be reused and the water can be recycled back to the feed box.

As previously stated, that the prior art method for recovering hydrocarbon diluent from tailings, which also used a vacuum flash vessel, resulted in only 60 to 65% recovery of diluent. The vessel used was equipped with a distributor box at its feed inlet, a stack of internal shed decks and a steam inlet positioned directly below the stack. The design concept was that volatiles would flash from the feed as it was introduced into the distributor box and residual tailings would then be distributed evenly over the shed decks. The countercurrently moving steam introduced beneath the stack of decks would heat the residual tailings and strip any additional diluent remaining in the tailings. However, it was discovered that the flashing at the inlet to the vessel resulted in turbulence, which caused poor distribution of feed to the shed decks. As a result the tailings tended, at least partly, to move down the vessel chamber wall along its inner surface, thereby partly bypassing the shed decks. Hence, the efficiency of the stripping section was low, the vessel was operating mainly as a flash vessel and the addition of steam at the bottom of the shed decks did not result in additional removal of diluent.

DESCRIPTION OF THE PREFERRED EMBODIMENT

Figure 1:
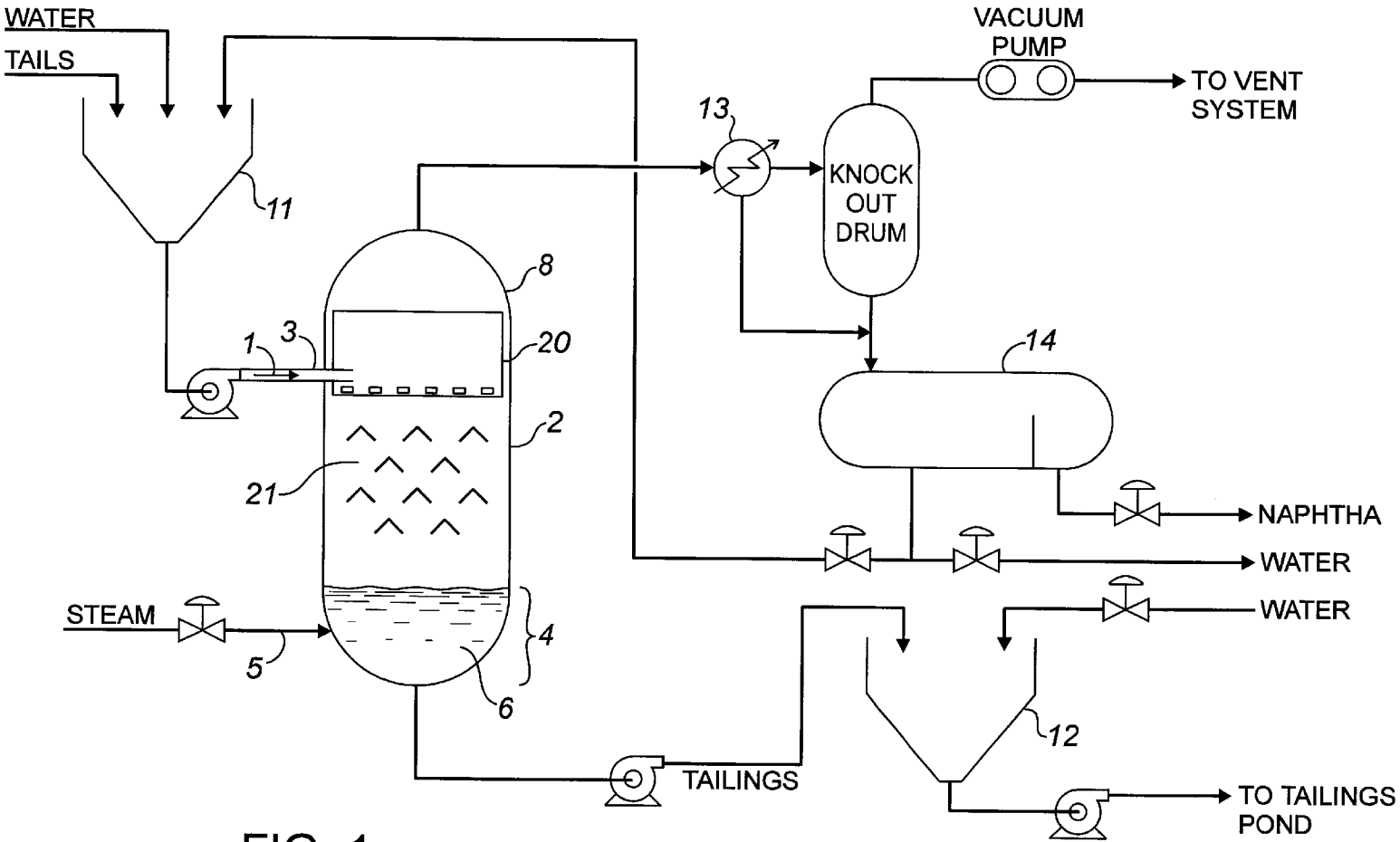
FIG. 1 is a schematic showing the hydrocarbon diluent extraction circuit.

The present method for hydrocarbon diluent recovery from heated froth treatment tailings can be best described with reference to FIG. 1. The heated tailings 1 are initially housed in a feed box 11 where additional water may or may not be added. The heated tailings are fed from the feed box 11, via an inlet pipe into into a distributor box 20 at the top end of the chamber 21 of the vacuum flash vessel 2. The chamber 21 is maintained at a pressure around 35 kPa. Flashing of diluent occurs in the upper portion 8 of the vessel chamber 21. The residual tailings then travel downwardly through the vessel 2 and collect as a pool 6 in the bottom portion 4 of the chamber 21. Steam 5 is injected directly into the residual tailings pool 6 in sufficient amount to provide the necessary heat for vaporizing contained hydrocarbon diluent along with a portion of the contained water. The "clean" residual tailings are continually removed through a line 22 to a tailings box 12. Additional water may be added to the tailings box 12 before the clean residual tailings are disposed into tailings ponds.

The vaporized diluent and water stream is passed through a condenser-cooler 13 where it is cooled. The liquid product is collected in a decanter 14, where the water settles to the bottom and the diluent floats to the top. The diluent can be reused and the water can be recycled back to the feed box.

EXAMPLE 1

The effect of direct steam injection into the tailings pool on the recovery of hydrocarbon diluent was tested as follows. The tailings feed tested contained approximately 1.5 wt. % naphtha, 2.5 wt. % bitumen, 17 wt. % solids and 79 wt. % water. The tailings were fed into the vacuum flash vessel at a rate of 175 l/sec (approximately 200 kg/sec) and the tailings temperature was about 72° C. The vacuum flash vessel was operated at a constant pressure of about 35 kPa.

The vacuum flash vessel was operated under the above conditions for a total of 375 minutes. Steam was continuously introduced into the vessel at a rate of 7 kg/sec. Initially steam was introduced into the vessel above the tailings pool and the naphtha flow rate (in l/sec) was measured at various intervals during this time. After 30 minutes the steam was injected directly into the tailings pool for 95 minutes and the naphtha flow rate was determined periodically throughout this period of time. For the next 75 minutes, steam was injected above the tailings pool and the naphtha flow rate was determined periodically. For the next 75 minutes, steam was injected directly into the tailings pool and naphtha recovery determined. Finally, from 275 to 375 minutes, steam was injected above the tailings pool and naphtha recovery was measured.

Figure 2:
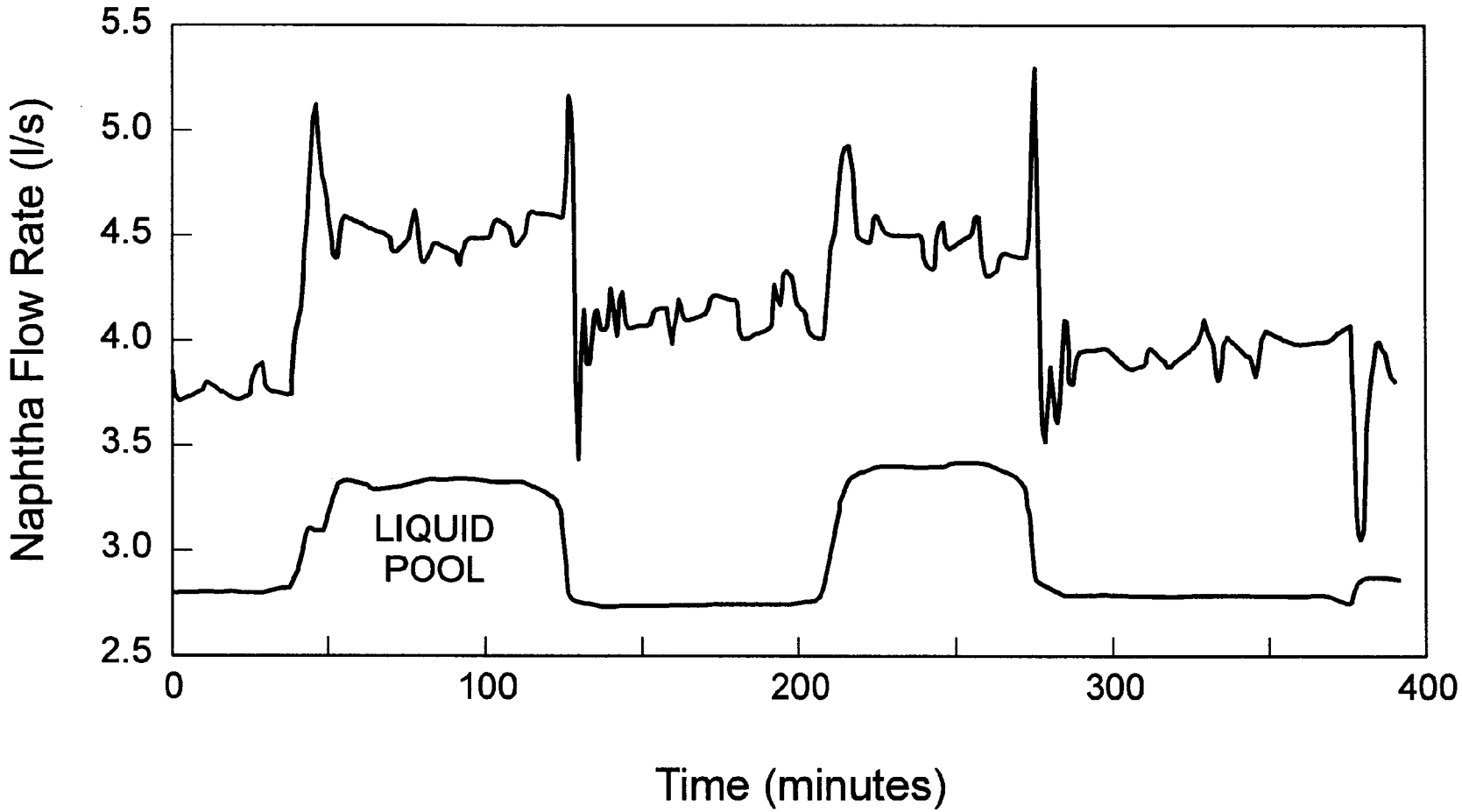
FIG. 2 is a plot of the naphtha flow rate versus time showing the effect on naphtha recovery when steam is injected above the tailings pool and when steam is injected directly into the tailings pool.

FIG. 2 shows that when steam is injected directly into the tailings pool, there is an increase in the amount of naphtha recovered.

The embodiment of the invention in which an exclusive property or privilege is claimed are defined as follows:

1. A method for recovering hydrocarbon diluent from a slurry comprising heavy oil, particulate solids, diluent and water, comprising:

introducing the slurry into a vacuum flash vessel chamber maintained at a sufficiently low sub-atmospheric pressure to vaporize the major portion of the contained diluent and some water and forming a pool of residual slurry at the bottom of the chamber, said residual slurry containing diluent and water;

introducing sufficient steam into the residual slurry pool to vaporize contained diluent and water; and separately removing vapors and residual slurry from the chamber.

2. The method as set forth in claim 1 wherein the slurry is introduced at a rate of about 150 to 300 kg/sec and steam is injected into the pool at a rate of about 7 to 14 kg/sec.

3. The method as set forth in claim 2, wherein the flash vessel chamber is maintained at a pressure of about 13 to 70 kPa.

4. The method as set forth in claim 2 wherein the flash vessel chamber is maintained at a pressure of about 30 to 35 kpa.

5. The method as set forth in claim 1 wherein the slurry is froth treatment tailings and the diluent is selected from the group consisting of naphtha and parafinnic diluent.

6. The method as set forth in claim 2 wherein the slurry is froth treatment tailings and the diluent is selected from the group consisting of naphtha and parafinnic diluent.

7. The method as set forth in claim 3 wherein the slurry is froth treatment tailings and the diluent is selected from the group consisting of naphtha and parafinnic diluent.

8. The method as set forth in claim 4 wherein the slurry is froth treatment tailings and the diluent is selected from the group consisting of naphtha and parafinnic diluent.

9. The method as set forth in claim 5 wherein sufficient steam is introduced into the residual slurry pool so that at least 80% of the diluent is recovered from the slurry.

10. The method as set forth in claim 6 wherein sufficient steam is introduced into the residual slurry pool so that at least 80% of the diluent is recovered from the slurry.

11. The method as set forth in claim 7 wherein sufficient steam is introduced into the residual slurry pool so that at least 80% of the diluent is recovered from the slurry.

12. The method as set forth in claim 8 wherein sufficient steam is introduced into the residual slurry pool so that at least 80% of the diluent is recovered from the slurry.

* * * * *